US005457929A

United States Patent [19]

Kim

[11] Patent Number: 5,457,929

[45] Date of Patent: Oct. 17, 1995

[54] STRUCTURAL MEMBER WITH A METAL SHELL

[76] Inventor: Joong S. Kim, 48-18, Yeonhee 3-Dong, Seodaemoon-Ku, Seoul, Rep. of Korea

[21] Appl. No.: 99,329

[22] Filed: Jul. 30, 1993

Related U.S. Application Data

[63] Continuation-in-part of Ser. No. 777,618, Oct. 16, 1991, Pat. No. 5,263,297, which is a continuation-in-part of Ser. No. 608,369, Nov. 2, 1990, abandoned.

[30] Foreign Application Priority Data

Nov. 2, 1989 [KR] Rep. of Korea ..... 1989-15859

[51] Int. Cl.[6] ..... E04C 3/00

[52] U.S. Cl. ..... 52/721.4; 52/726.2; 52/726.3; 52/244; 52/301; 52/723.1

[58] Field of Search ..... 52/244, 301, 721–728, 52/731.1, 731.5, 704

[56] References Cited

U.S. PATENT DOCUMENTS

| | | | |
|---|---|---|---|
| 614,729 | 11/1898 | Lally | 52/301 |
| 820,156 | 5/1906 | Tresidder . | |
| 836,673 | 11/1906 | Ford . | |
| 1,489,742 | 4/1924 | Davenhall . | |
| 1,615,815 | 1/1927 | Birdsey | 52/725 X |
| 1,971,051 | 8/1934 | Reiner et al. . | |
| 2,099,470 | 11/1937 | Coddington . | |
| 2,210,553 | 8/1940 | Miller . | |
| 2,874,546 | 2/1959 | Fox . | |
| 3,199,300 | 8/1965 | Fiore | 52/725 X |
| 3,333,808 | 8/1967 | DuBoff . | |
| 3,501,881 | 3/1970 | Van Buren . | |
| 3,810,337 | 5/1974 | Pollard . | |
| 3,858,374 | 1/1975 | Ben-Zvi . | |
| 4,694,622 | 9/1987 | Richard . | |
| 4,910,940 | 3/1990 | Grady, II . | |
| 5,263,297 | 11/1993 | Kim | 52/724 |

FOREIGN PATENT DOCUMENTS

| | | |
|---|---|---|
| 145171 | 2/1952 | Australia . |
| 537658 | 1/1956 | Italy . |
| 197711 | 11/1977 | U.S.S.R. . |

*Primary Examiner*—Carl D. Friedman
*Assistant Examiner*—Robert J. Canfield
*Attorney, Agent, or Firm*—Sterne, Kessler, Goldstein & Fox

[57] ABSTRACT

Disclosed herein is a structural member comprising an elongated hollow thin metal shell and a filler moulded into the hollow thin metal shell. A reinforcing end piece is engaged with an end portion of the shell and is embedded in the filler in order to prevent the end portion of the shell from deforming in the process of injecting the filler into the shell and to prevent the end portions of the structural member from rupturing or breaking during transportation or construction thereof. In addition, the reinforcing end piece includes an inner wall in contact with an inner surface of the end portion of the shell, an outer wall spaced from the inner wall and in contact with an outer surface of the end portion, and a recessed portion provided between the inner and the outer walls for receiving the end portion of the shell.

19 Claims, 6 Drawing Sheets

STRUCTURAL MEMBER WITH A METAL SHELL

CROSS REFERENCE TO RELATED APPLICATIONS

This application is a continuation-in-part of application Ser. No. 07/777,618, filed Oct. 16, 1991, now U.S. Pat. No. 5,263,297, which is a continuation-in-part of application Ser. No. 07/608,369, filed Nov. 2, 1990, now abandoned.

BACKGROUND OF THE INVENTION

1. Field of the Invention

The present invention relates to a structural member with a metal shell; and, more particularly, to a novel structural member fabricated by injecting a filler, e.g., concrete mortar, into an elongated hollow thin metal shell, which is adapted to be used in combination with a base, a wall and other members.

2. Description of the Prior Art

In general, a Structural member such as a pillar, column, post, pole, beam and the like is made of lumber, concrete, metal or their composites according to its appropriate use.

In particular, a structural member made of concrete has been widely used in the construction field because of its high compressive strength and economy. Also, it has a further advantage that it can be easily made in various shapes by designing diverse molds. However, such concrete columns and posts are not normally suitable for use in decorative articles due to their rough surface characteristics and non-aesthetic appearance. Accordingly, additional finishing elements made of lumber and/or metal plates are required to refurbish the crude surfaces of the concrete members in order to employ them for sophisticated purposes.

Consequently, hollow metal structural members made of, e.g., aluminum, aluminum alloys, stainless steel, zinc plated steel, special steel, copper or copper alloys are increasingly employed in various structural members such as supporting columns, connecting bars, ornamental poles and the like because of their appealing appearance, high corrosive resistance and easy workability. In such hollow metal members, relatively greater thickness is required to withstand a given load, thereby entailing a high material/manufacturing cost.

Therefore, there have been attempts made to reduce the thickness of such a hollow metal structure by way of forming a section of the structure in a bent or inwardly grooved shape and to thereby increase the bending strength and the moment of inertia of the metal structure. However, the manufacturing cost of such metal member still remains relatively high because the formation of a particular shape in the metal member adds further manufacturing steps. In addition, reducing the thickness of the metal member in the effort to reduce the cost can backfire as it makes the structure vulnerable to a sudden external force.

Accordingly, various structural members have been developed with the specific view to improving their tensile and compressive strength.

For example, U.S. Pat. No. 836,673 issued to A. W. Ford teaches a metal column filled with concrete therein, including reinforcing metal tubes placed in the column at its weakest or breaking points and embedded in the concrete. In U.S. Pat. Nos. 1,934,260 and 1,971,051, there are provided structural members comprising a concrete core, a metal shell enclosing the core and plates mounted in both ends of the core wherein the plates transmit and distribute compressed loads over the concrete core.

U.S. Pat. No. 3,468,090 to L' Hermite discloses a reinforced concrete structure which comprises a concrete core, a continuous metal reinforcement surrounding the concrete core, and a high strength adhesive interposed between the surfaces of the core and the reinforcement.

Although the concrete structural members disclosed in the above patents may have been useful for their intended purposes, they are not suitable for use in large contemporary constructional structures, which are normally built with structural members requiring high-cost metal shells of greater thickness.

In U.S. Pat. Nos. 2,874,546, 3,333,808 and 4,910,940, there are provided various devices for securing concrete structural columns or posts to a base. However, in such securing devices, substantial labor is required to assemble and install the parts due to their complicated structures.

SUMMARY OF THE INVENTION

Accordingly, it is an object of the present invention to provide a novel structural member with a thin shell made of metal or plastic, which is adapted to be used in combination with a base with ease.

It is another object of the present invention to provide a structural member with a thin metal shell, having reinforcing end pieces adapted for preventing the deformation of either end of the thin metal shell during the process of manufacturing the structural member and for minimizing or preventing the rupture and destruction in both end portions of the structural member, e.g., during the course of transportation and/or construction.

It is still another object of the present invention to provide a structural member having coupling elements for attaching it to a base or other structural members.

It is a further object of the present invention to provide a structural member which can be manufactured at a relatively low cost by minimizing the thickness of a metal shell, while maintaining the structural integrity of the member.

The above and other objects of the present invention are accomplished by providing a structural member which comprises:

an elongated hollow thin metal shell;

a reinforcing end piece engaged with an end portion of the shell, said reinforcing end piece having an inner wall in contact with an inner surface of the end portion of the shell, an outer wall spaced from the inner wall and in contact with an outer surface of the end portion, a recessed portion provided between the inner and the outer walls for accommodating the end portion of the shell, and a through-hole provided at the inner wall; and a filler moulded into the hollow thin shell and the through-hole of the reinforcing end piece.

BRIEF DESCRIPTION OF THE DRAWINGS

The above and other objects and advantages of this invention will be apparent from the following description and accompanying drawings, wherein like numbers refer to like parts in different views.

DETAILED DESCRIPTION OF THE INVENTION

Figure 1:
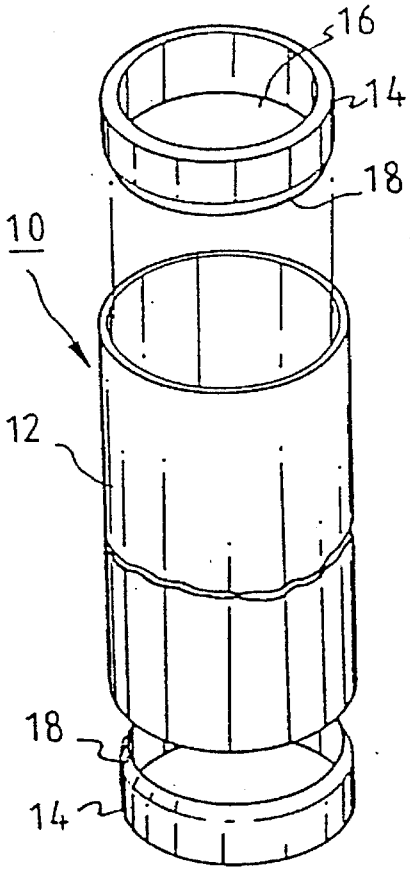
FIG. 1 is a partially exploded perspective view, with a filler of concrete removed for the sake of clarity, of a preferred structural member in accordance with the present invention, showing an elongated hollow thin shell and reinforcing end pieces designed to engage with the ends of the shell.
Figure 2:
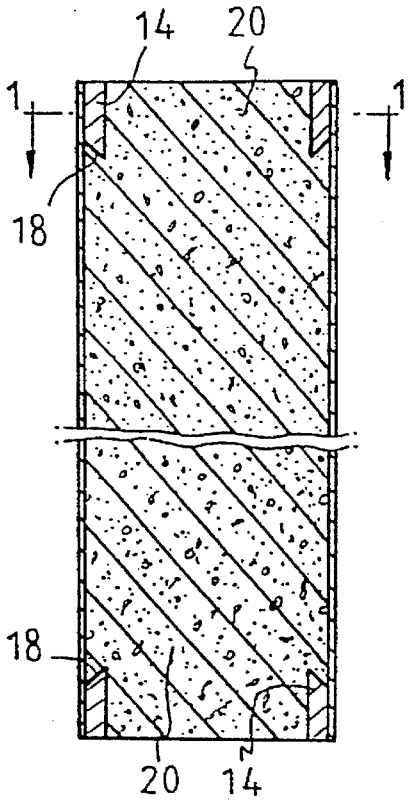
FIG. 2 is a vertical sectional view of the structural member of FIG. 1, fabricated in accordance with the present invention.
Figure 3:
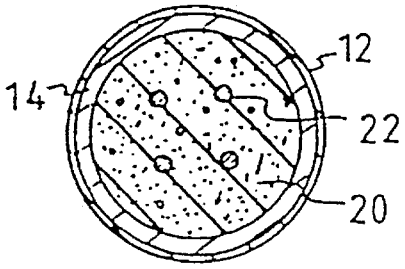
FIG. 3 is a sectional view taken along line 1—1 of FIG. 2.

Referring now to FIGS. 1 to 3, there is shown a structural member 10 in accordance with a preferred embodiment of the present invention, which comprises an elongated hollow thin shell 12, reinforcing end pieces 14 engaged with the ends of the hollow thin shell 12 and a filler 20, e.g., concrete filled in the shell 12.

In the structural member of the invention, the hollow thin shell 12 may be made of plastic or metal such as stainless steel, aluminium, copper or their respective alloys. It should be noted that the hollow shell 12 is relatively thin in order to reduce or minimize its manufacturing cost. The thickness of the shell 12 is preferably within the range of 0.2 mm to 3 mm and may be appropriately determined depending upon the diameter and use of the structural member 10. As described above, since the hollow shell 12 is relatively thin, it may be easily deformed, especially at its end portions. Accordingly, the reinforcing end pieces 14 are provided to prevent the deformation at both ends of the hollow shell as will be described more fully below.

Figure 15:
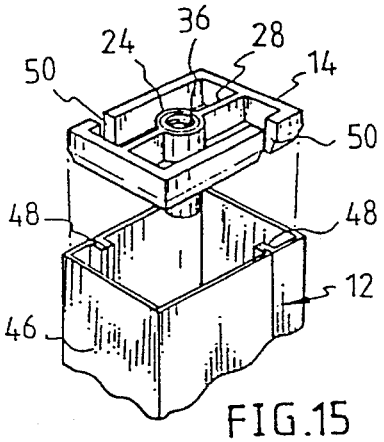
FIG. 15 shows an alternatively modified structural member of the present invention.
Figure 21:
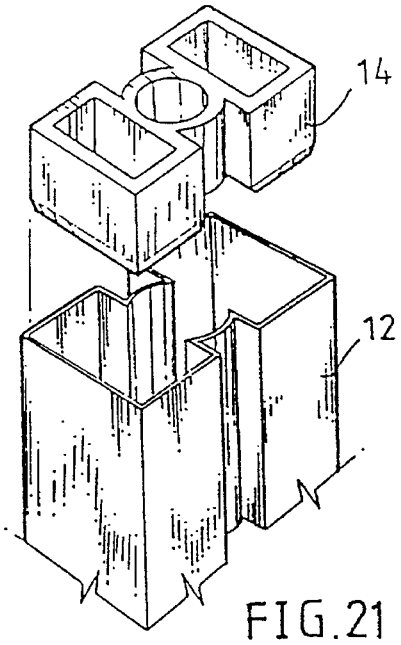
FIGS. 21 and 22 are partially exploded perspective views of various structural members, with parts and a concrete filler removed for clarity, of the present invention.
Figure 22:
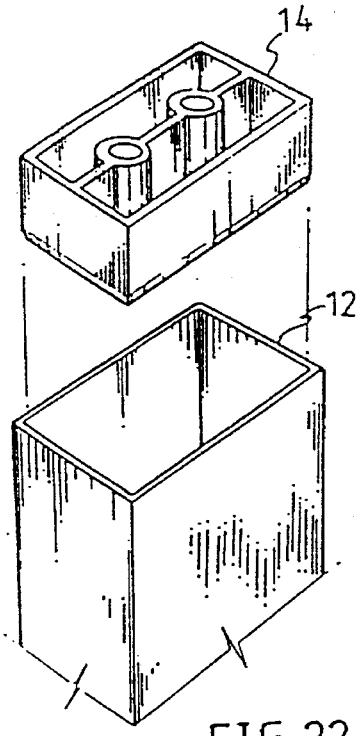

In this embodiment, although the structural member 10 is of a circular shape, it is not limited to this and may have various configurations(see FIGS. 15, 21 and 22).

The reinforcing end pieces 14 are designed to be tightly engaged with both ends of the hollow shell 12 and respectively have a through-hole 16 to facilitate the injection of concrete mortar into the hollow shell 12 therethrough in the manufacture of the structural member 10. In addition, provided around an end portion of the end piece 14 is a slightly tapered surface 18 which facilitates the insertion of the end piece 14 into the end portion of the hollow shell 12(see FIG. 1). The end pieces 14 may be bonded to the inner surfaces of the end portions of the hollow shell 12 by the use of, e.g., an adhesive.

The end pieces 14 serve as a reinforcement preventing the deformation at the end sections of the hollow shell 12 during, e.g., the injection of a filler therein; and the rupture and destruction of the end sections of the finished structural member, e.g., in the course of, transportation.

In this embodiment, although the end piece 14 is formed of a ring shape, it may have other forms compatible with that of the hollow shell 12. It is preferable that the end piece 14 be made of a metal, synthetic resin, or other plastic material.

As best shown in FIG. 2, filled and hardened in the hollow shell 12 is concrete as a filler 20. The filler 20 may be made of plastic concrete, porous concrete, expoxy concrete, lightweight concrete, mortar, artificial marble mortar, ferro concrete and the like. In general, the filler 20 serves to resist a load imposed on the structural member 10 and to withstand external shock exerted on the shell 12. In order to increase the compressive strength of the filler 20, preferably embedded in the filler 20 may be a plurality of reinforcing steel rods 22.

Figure 4:
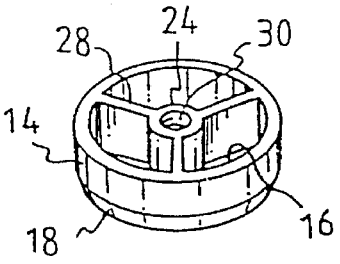
FIG. 4 is a perspective view of a reinforcing end piece with a coupling element suitable for coupling an inventive structural member with a base or other members.
Figure 5:
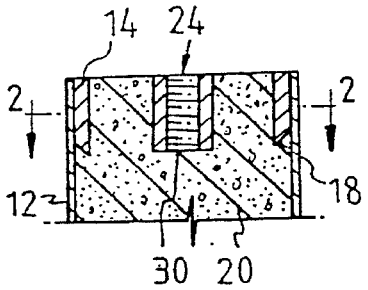
FIG. 5 is a partially vertical sectional view of another preferred structural member incorporating the reinforcing end piece of FIG. 4.
Figure 6:
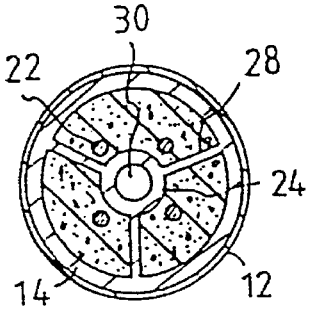
FIG. 6 is a sectional view taken along line 2—2 of FIG. 5.

FIGS. 4 to 6 show another preferred embodiment of the invention which is significantly different from the first one.

Figure 24:
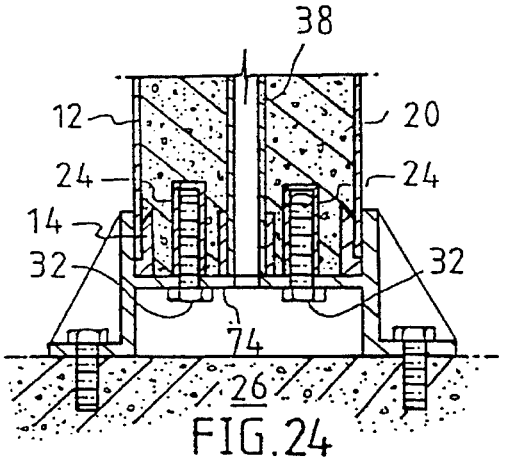
FIGS. 24 and 25 are partially vertical sectional views of the structural members of the present invention secured to other members by way of employing coupling elements provided at the reinforcing end pieces.
Figure 25:
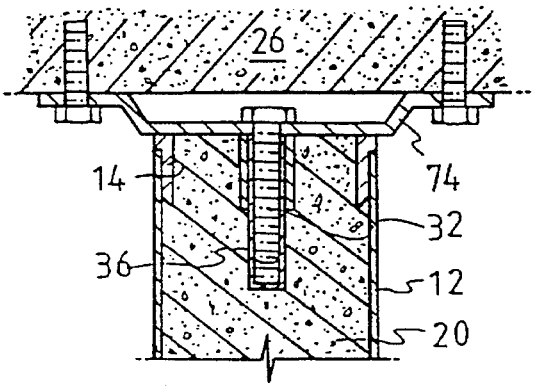

As shown in FIG. 4, the reinforcing end piece 14 comprises a plurality of ribs 28 traversing the through-hole 16, and a coupling means 24 provided at a crossed central portion of the ribs 28 adapted for coupling the structural member 10 with a base 26(shown in FIGS. 24 and 25).

The coupling means 24 has a threaded hole 30 which is adapted to be engaged with a fixture, e.g., a bolt. Consequently, the structural member 10 can be secured to the base 26 by engaging a bolt 32 in the threaded hole 30 through a bracket 74 mounted in the base 26(see FIGS. 24 and 25).

Figure 7:
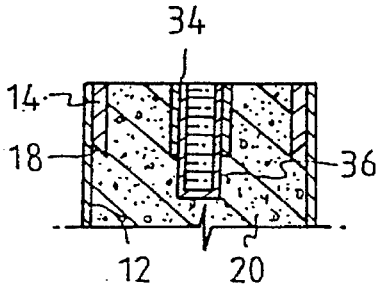
FIG. 7 is a sectional view similar to that of FIG. 5 but highlighting an alternative coupling element embedded in a concrete filler.

An alternative embodiment is shown in FIG. 7 which is similar to the one shown in FIG. 5 with the exception of the means for coupling the structural member 10 with the base 26.

In this embodiment, the coupling means 24 includes an opening 34 formed in the crossed central portion of the ribs 26 and a female thread 36 tightly engaged in the opening 34 and adapted to receive the bolt 32(FIG. 24). The female thread 36 is preferably embedded in the filler 20 through the opening 34 in order to securely maintain the attachment of the structural member 10 to the base 26.

Figure 8:
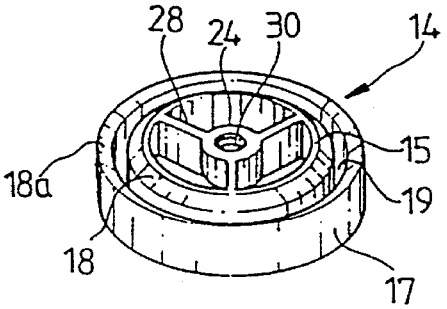
FIG. 8 is a perspective view of another embodiment of the reinforcing end piece in accordance with the present invention.
Figure 9:
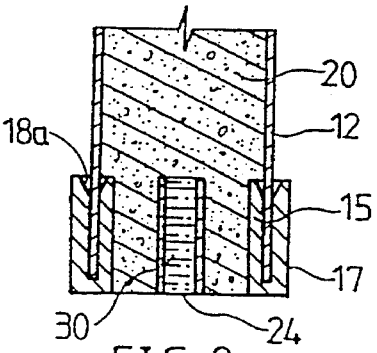
FIG. 9 is a partially vertical sectional view of a further embodiment of the instant structural member, incorporating the reinforcing end piece of FIG. 8.

FIGS. 8 and 9 show another reinforcing end piece 14 of the present invention which is useful for protecting the end portions of the thin hollow shell 12. The reinforcing piece 14 includes an inner wall 15 in contact with an inner surface of the end portion of the shell 12, an outer wall 17 spaced from the inner wall 15 for protecting an outer surface of the end portion of the shell 12, and a recessed portion 19 provided between the inner and the outer walls 15, 17 for receiving the end portion of the shell 12 therein as shown in FIG. 9. In this embodiment, it should be noted that the outer wall 17 of the reinforcing piece 14 functions as a protective cover against the rupture of the end portion of the thin shell 12 during the transportation and/or construction of the structural member. In addition, formed at the outer wall 17 is a slightly tapered surface 18*a* which is arranged in an opposite relationship with the tapered surface 18 of the inner wall 15 so as to easily fit the end piece 14 into the end portion of the hollow shell 12.

Figure 10:
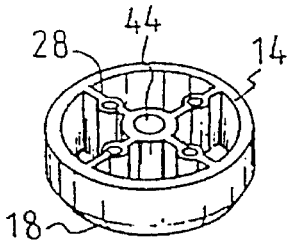
FIG. 10 is a perspective view of a modified reinforcing end piece with an aperture adapted for receiving a hollow pipe to be embedded in concrete.
Figure 11:
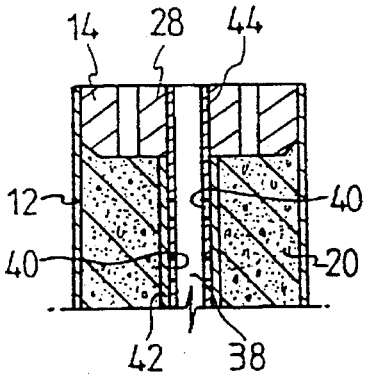
FIG. 11 is a partially vertical sectional view of a modified structural member of the present invention, incorporating the reinforcing end piece of FIG. 10.

FIGS. 10 and 11 show a modified structural member 10 of the present invention which is useful for receiving electrical wires or telecommunication cables(not shown).

In this embodiment, embedded in the concrete filler 20 of the structural member 10 is a hollow pipe 38 which can accommodate the electrical wires therein and includes a plurality of apertures 40 to discharge surplus water contained in the concrete mortar injected into the shell 12 through the pipe 38. Preferably, partially wrapping around the outer surface of the hollow pipe 38 is a filter 42 such as a woven fabric, which can prevent the concrete mortar from passing through the apertures 40 of the pipe 38.

In addition, both end portions of the hollow pipe 38 are engaged in a hole 44 provided at the crossed central portion of the ribs 28 of the reinforcing end pieces 14, respectively.

Figure 12:
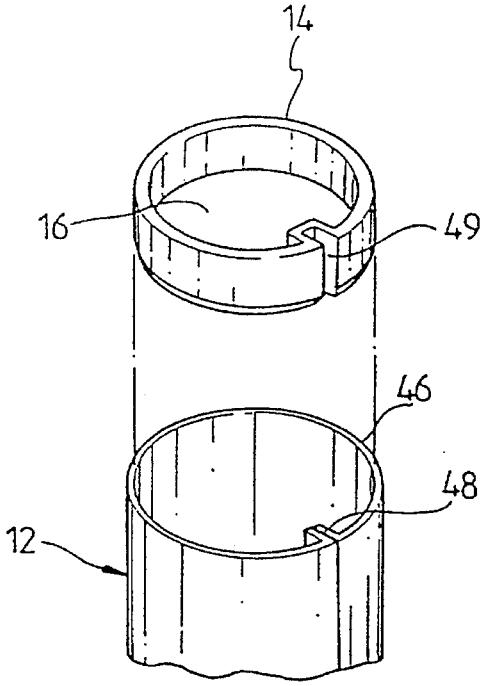
FIG. 12 is a partially exploded perspective view of a further modified structural member, with parts and a concrete filler broken away for clarity, of the present invention.

Another modified structural member 10 shown in FIG. 12 comprises the hollow shell 12 made by bending a thin plate 46 in a cylindrical configuration and then welding inwardly bent flanges 48 thereof. In this preferred embodiment, provided at the reinforcing end piece 14 is a groove or cut-out portion 49 which can engage with the bent flanges 48 of the hollow shell 12.

Figure 13A:
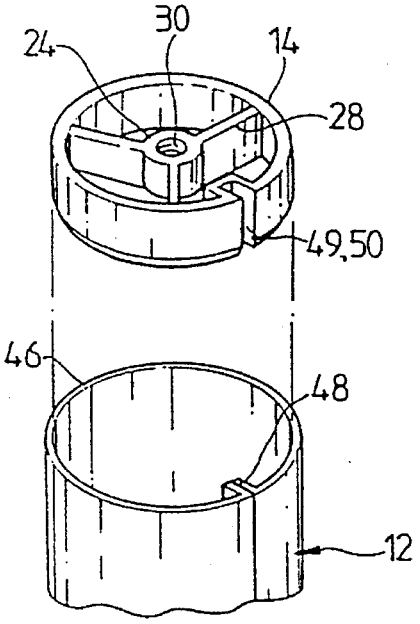
FIGS. 13A and 13B are partially exploded perspective views of alternatively modified structural members in accordance with the present invention.

The hollow shell 12 of the structural member 10 shown in FIG. 13A is identical to that of FIG. 12. However, the end piece 14 is similar to the one shown in FIG. 4 but has an engaging means, e.g., the groove 49 or a slit portion 50 adapted to be engaged with the welded flanges 48 of the hollow shell 12.

Figure 13B:
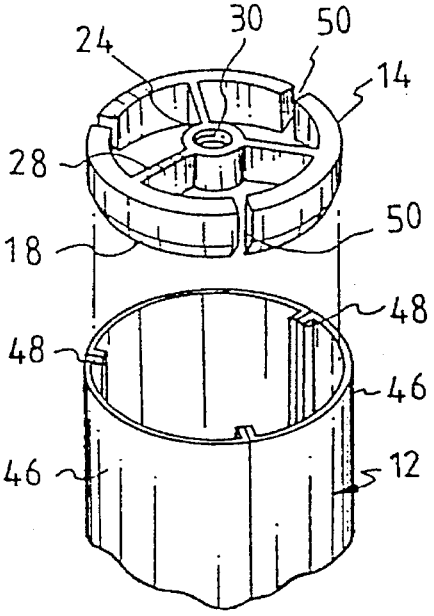

FIG. 13B shows an alternatively modified structural member 10 wherein the hollow shell 12 consists of three thin plates 46 welded together at their inwardly bent flanges 48. Similarly, the reinforcing end piece 14 has three grooves or slit portions 50 corresponding to the bent flanges 48 of the hollow shell 12.

Figure 14:
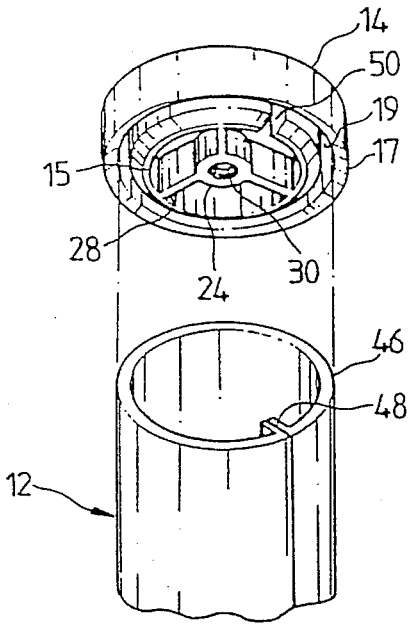
FIG. 14 is a view similar to that of FIG. 13A, but shows an alternatively modified reinforcing end piece adapted to be engaged with the ends of the shell shown in FIG. 13A.

In FIG. 14, there is an alternatively modified reinforcing piece 14 which can be employed in the structural member 10 of FIG. 12. This reinforcing piece 14 is substantially similar to that shown in FIG. 8 except that its inner wall 15 has the groove 49 or silt portion 50 engaged with the bent flanges 48 of the hollow shell of FIG. 12.

FIG. 15 shows a further modified structural member 10 of the invention which is formed of a square shape, different from the circularly shaped structural members 10 of FIGS. 13A and 13B. In this preferred embodiment, the hollow shell 12 may be made in a square form by welding or bonding the inwardly bent flanges 48 of appropriately preformed thin plates 46 in a similar way as described in the previous embodiment(FIG. 12). The reinforcing end piece 14 also includes the grooves 49 or slit portions 50 complementary to the welded or bonded flanges 48 of the hollow shell 12 and is made in a square shape substantially identical to that of the hollow shell 12. The coupling means 24 provided in the end piece 14 is the same as that described in connection with FIG. 7.

Figure 16:
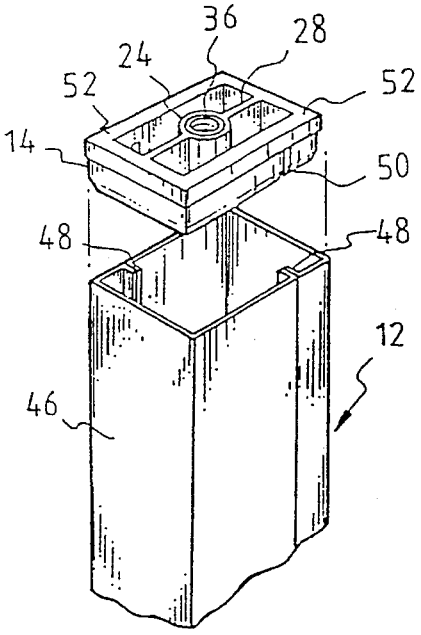
FIG. 16 is a view similar to that of FIG. 15, but shows an additionally modified reinforcing end piece of the present invention.
Figure 18:
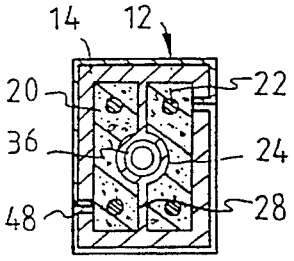
FIG. 18 is a sectional view taken along line 3—3 of the structural member shown in FIG. 17.
Figure 17:
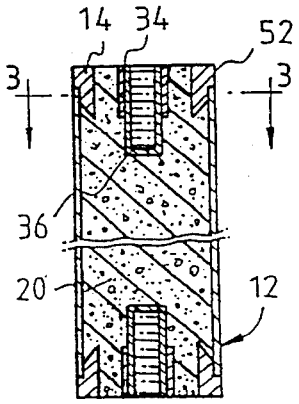
FIG. 17 is a vertical sectional view of the structural member of FIG. 16, having concrete moulded into the hollow shell.

In FIGS. 16 to 18, there is provided a still modified structural member 10 of the invention, which is fundamentally the same as the former embodiment shown in FIG. 15 with the exception of the structure of the reinforcing end piece 14. In this embodiment, integrally formed on the outer periphery of the end piece 14 is a projecting flange 52 which can be seated on the end of the shell 12 when the end piece 14 is fully engaged with the shell 12. As best shown in FIG. 17, the outer periphery of the projecting flange 52 is preferably constructed to substantially lie coplanar with the end surface of the hollow shell 12.

Figure 19:
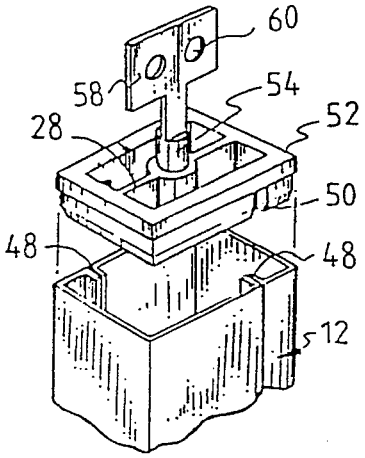
FIG. 19 is a view similar to FIG. 16 and illustrates a modified coupling element associated with the reinforcing end piece.
Figure 20:
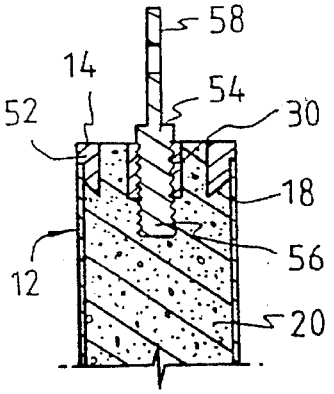
FIG. 20 is a partially vertical sectional view of the structural member with concrete moulded into the hollow shell as shown in FIG. 19.

The embodiment of FIGS. 19 and 20 is the same as that described with reference to FIGS. 16 to 18 with the exception that the reinforcing piece 14 has a bolt or anchor 54 engaged in the threaded hole 30 of the ribs 28 and extended outwardly therefrom instead of the female thread 36 engaged in the opening 34 thereof.

The lower portion 56 of the anchor 54 is embedded in the concrete filler 20. The outer extension 58 of the anchor 54 has at least one engaging aperture 60 for providing the coupling of the structural member 10 to other members in a suitable manner.

In FIGS. 21 and 22, there are provided varied forms of the hollow shell 12 and the end piece 14 corresponding to the shell 12, with the concrete filler 20 being removed for the sake of clarity, in accordance with other preferred embodiments of the invention.

Figure 23:
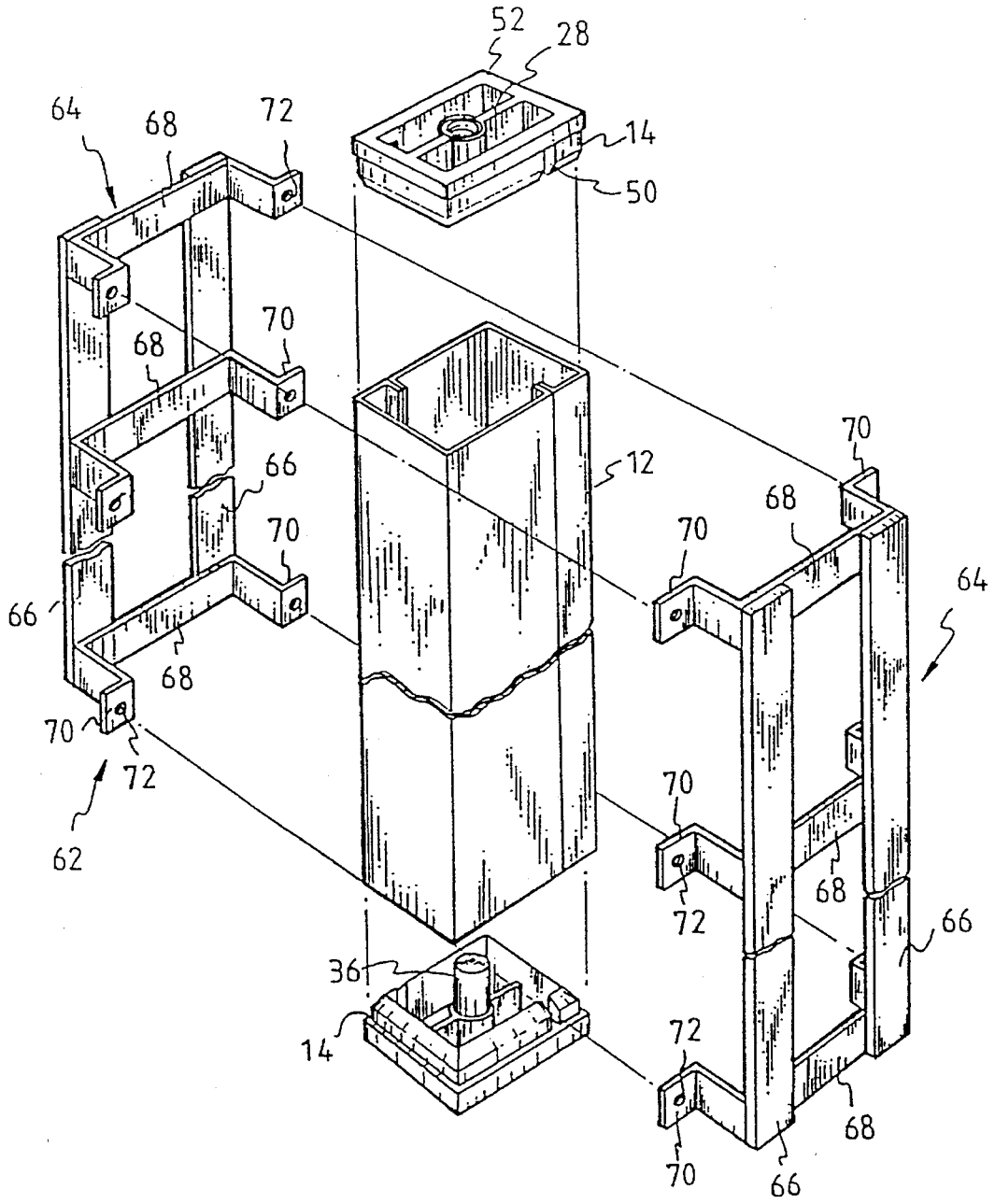
FIG. 23 is an exploded perspective view of a supporting device designed to prevent the deformation of an elongated hollow thin shell in fabricating the structural member shown in FIG. 16.

In FIG. 23, there is shown an exemplary supporting device 62 designed to be used in fabricating the structural member 10 of the invention as shown in FIGS. 16 to 18.

As described above, since the hollow shell 12 used in the invention is relatively thin, it may be deformed in the process of pouring the filler, e.g., mortar, inside the shell 12. Therefore, the supporting device 62 as shown in FIG. 23 may be beneficially used to maintain the outer Shape of the hollow shell 12 without risking its deformation while carrying out the task of filling, e.g., mortar.

The device 62 comprises a pair of separable holders 64 for supporting the outer surface of the hollow shell 12. The respective holders 64 have a pair of spaced parallel frames 66 and a plurality of transverse members 68 spacedly secured to the frames 66 and having an appropriate shape corresponding to that of the hollow shell 12.

The respective transverse members 68 have flanges 70 outwardly extended from each of the end portions thereof in a perpendicular relationship and having holes 72 for receiving a bolt(not shown). Additionally, it is desirable to attach impact-relieving pads(not shown) to the inner surfaces of the respective transverse members 68 in order to efficiently prevent the deformation of the hollow shell 12.

Therefore, in the fabrication of the structural member 10 in accordance with the invention, the reinforcing end pieces 14 are inserted into both ends of the hollow shell 12 prior to the injection of mortar into the hollow shell 12. And then, the half holders 64 are oppositely disposed at the outer sides of the hollow shell 12, respectively, and assembled with each other by way of connecting the corresponding flanges 70 of the transverse members 68 through, e.g., bolting. Accordingly, the transverse members 68 support the outer sides of the hollow shell 12 and, therefore, prevent the hollow shell 12 from deforming when mortar is poured into the shell 12.

FIGS. 24 and 25 show some exemplary embodiments of coupling the structural member 10 with a base in accordance with the invention.

As best illustrated in FIG. 24, the lower portion of the structural member 10 may be secured to a bracket 74 mounted on the base 26, by means of securing the bolt 32 into the threaded hole 30 through the bracket 74.

In addition, as alternatively shown in FIG. 25, the upper portion or both end portions of the structural member 10 may be attached to the bracket 74, e.g., in the manner described above.

Although this invention has been shown and described with respect to the above preferred embodiments, it will be understood by those skilled in the art that certain changes and modifications may be made without departing from the spirit and scope of the invention as defined in the following claims.

What is claimed is:

1. A structural member adapted to be used in combination with a base, which comprises:

an elongated hollow thin metal shell;

a reinforcing end piece engaged with an end portion of the shell, said reinforcing end piece including an inner wall in contact with an inner surface of the end portion of the shell, an outer wall spaced from the inner wall and in contact with an outer surface of the end portion, the inner and the outer walls of the reinforcing end piece having tapered surfaces arranged in an opposite relationship with each other, a recessed portion provided between the inner and the outer walls for accommodating the end portion of the shell, and a through-hole provided at the inner wall; and a filler moulded into the hollow thin shell and the through-hole of said reinforcing end piece.

2. The structural member of claim 1 wherein said reinforcing end piece further comprises a plurality of ribs traversing the through-hole thereof.

3. The structural member of claim 2 wherein said reinforcing end piece includes means for coupling the structural member with a base.

4. The structural member of claim 3 wherein said coupling means comprises a threaded hole provided at a crossed central portion of the ribs.

5. The structural member of claim 3 wherein said coupling means comprises an opening provided at a crossed central portion of the ribs and a female thread tightly engaged in the opening and partially embedded in the filler.

6. A structural member adapted to be used in combination with a base, which comprises:

an elongated hollow metal shell consisting of at least one thin plate welded together at inwardly bent flanges of the plate;

a reinforcing end piece tightly engaged in an end portion of the shell, said reinforcing end piece having a through-hole and a groove at its outer surface complementary to the inwardly bent flanges of the plate; and a filler moulded into the hollow thin shell and the through-hole of said reinforcing end piece.

7. The structural member of claim 6 wherein said reinforcing end piece has a tapered surface-formed around an end portion thereof.

8. The structural member of claim 7 wherein said reinforcing end piece further comprises a plurality of ribs traversing the through-hole thereof.

9. The structural member of claim 8 wherein said reinforcing end piece includes means for coupling the structural member with the base.

10. The structural member of claim 9 wherein said coupling means comprises a threaded hole provided at a crossed central portion of the ribs.

11. The structural member of claim 10 wherein said coupling means further comprises a bolt engaged in the threaded hole and partially embedded in the filler.

12. The structural member of claim 9 wherein said coupling means comprises an opening provided at a crossed central portion of the ribs and a female thread tightly engaged in the opening and partially embedded in the filler.

13. The structural member of claim 6 wherein said reinforcing end piece further comprises a projecting flange integrally formed on an outer periphery thereof and seated on the end surface of the shell, a plurality of ribs traversing the through-hole thereof, and coupling means provided at a crossed central portion of the ribs for coupling the structural member with the base.

14. A structural member adapted to be used in combination with a base, which comprises:

an elongated hollow metal shell consisting of at least one thin plate welded together at inwardly bent flanges of the plate;

a reinforcing end piece engaged with an end portion of the shell, said reinforcing end piece having an inner wall in contact with an inner surface of the end portion of the plate, an outer wall spaced from the inner wall and in contact with an outer surface of the end portion, a recessed portion provided between the inner and the outer walls for accommodating the end portion of the shell, and a through-hole provided at the inner wall, the inner wall of said reinforcing end piece having a groove or a slit portion suitable for engaging with the bent flanges of the shell; and a filler moulded into the hollow shell and the through-hole of said reinforcing end piece.

15. The structural member of claim 14 wherein the inner and the outer walls of said reinforcing end piece have tapered surfaces arranged in an opposite relationship with each other.

16. The structural member of claim 15 wherein said reinforcing end piece further comprises a plurality of ribs traversing the through-hole thereof.

17. The structural member of claim 16 wherein said reinforcing end piece includes means for coupling the structural member with the base or other parts thereof.

18. The structural member of claim 17 wherein said coupling means comprises a threaded hole provided at a crossed central portion of the ribs.

19. The structural member of claim 17 wherein said coupling means comprises an opening provided at a crossed central portion of the ribs and a female thread tightly engaged in the opening and partially embedded in the filler.

* * * * *

UNITED STATES PATENT AND TRADEMARK OFFICE

CERTIFICATE OF CORRECTION

PATENT NO. : 5,458,929

DATED : October 17, 1995

INVENTOR(S) : Jimmy D. Earls, et al.

It is certified that error appears in the above-indentified patent and that said Letters Patent is hereby corrected as shown below:

In column 31, in Formula V, between lines 55-60, should read

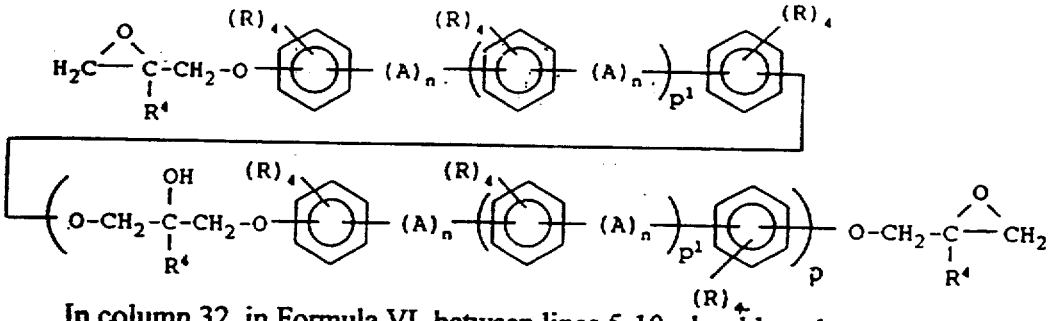

In column 32, in Formula VI, between lines 5-10, should read

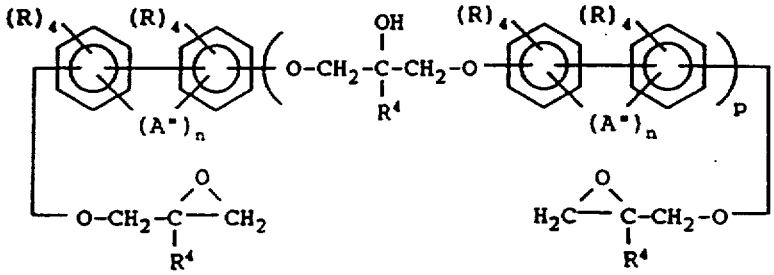

UNITED STATES PATENT AND TRADEMARK OFFICE

CERTIFICATE OF CORRECTION

PATENT NO. :5,458,929

DATED :October 17, 1995

INVENTOR(S) :Jimmy D. Earls, et al.

It is certified that error appears in the above-indentified patent and that said Letters Patent is hereby corrected as shown below:

In column 31, in Formula II, between lines 45-52, should read

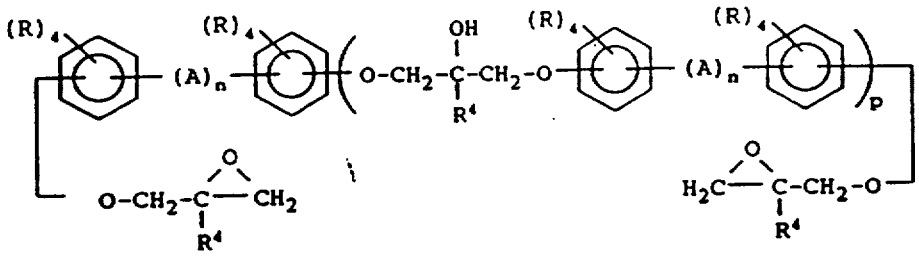

Signed and Sealed this

Third Day of December, 1996

*Attest:*

BRUCE LEHMAN

*Attesting Officer*

*Commissioner of Patents and Trademarks*